United States Patent [19]

Davis

[11] Patent Number: 4,993,557

[45] Date of Patent: Feb. 19, 1991

[54] CAP STORING DEVICE

[76] Inventor: Bert Davis, Rte. 2, Box 700, Centreville, Ala. 35402

[21] Appl. No.: 563,642

[22] Filed: Aug. 7, 1990

[51] Int. Cl.[5] ..... A47F 7/00

[52] U.S. Cl. ..... 211/30; 211/32; 211/49.1

[58] Field of Search ..... 211/30, 32, 33, 49.1, 211/87, 90

[56] References Cited

U.S. PATENT DOCUMENTS

| | | | |
|---|---|---|---|
| 657,629 | 9/1900 | Visel | 211/30 |
| 1,655,609 | 1/1928 | James | 211/30 |
| 1,736,809 | 11/1929 | Van Dyke | 211/30 X |
| 2,949,192 | 8/1960 | Maliff | 211/49.1 |
| 4,616,747 | 10/1986 | Zimmerman | 211/30 X |
| 4,805,782 | 2/1989 | Hale et al. | 211/30 |

*Primary Examiner*—Robert W. Gibson, Jr.
*Attorney, Agent, or Firm*—David H. Semmes

[57] ABSTRACT

Cap storing devices, particularly a stand for supporting a plurality of caps of the type having a deformable crown and an extended visor. The stand includes a base and upstanding back, together with a curvate shelf which engages the inner periphery of a folded crown, while the cap visor extends vertically in engagement with the back. A plurality of folded caps thus may be stacked one upon the other in storage mode.

8 Claims, 3 Drawing Sheets

CAP STORING DEVICE

BACKGROUND OF THE INVENTION (1) Field of the Invention

Hat or cap storing device, particularly a storage rack for supporting a plurality of baseball-type caps one upon the other with their visors extending vertically in parallel engagement with each other.

(2) Description of the Prior Art

Design Patents:

PALMENBERG: U.S. Pat. No. Des. 17,098

ROSENHEIM: U.S. Pat. No. Des. 159,536

Mechanical Patents:

SANDERS: U.S. Pat. No. 466,626

VISEL: U.S. Pat. No. 657,629

JAMES: U.S. Pat. No. 1,655,609

ZIMMERMAN: U.S. Pat. No. 4,616,747

HALE et al.: U.S. Pat. No. 4,805,782

Prior patentees have provided special clips and support members for the interior of a cap; however, none have suggested an apparatus for suppporting a number of caps stacked one upon the other with the cap visors aligned vertically parallel with the back wall of the support.

SUMMARY OF THE INVENTION

A cap storage device adapted for supporting a plurality of caps of the type having a crown with an extended visor, said storage device including a horizontal base defining rear and front portions, and upstanding back secured at its lower extremity to the base rear portion and extending vertically thereof; and a curvate lower shelf supported at one end upon said upstanding back and superposed with respect to the horozontal base, such that the folded crown of a cap may fit thereover with the cap visor extending vertically in parallel engagement with the back. A plurality of caps with their crowns folded may thus be stored one upon the other.

DESCRIPTION OF THE DRAWINGS

In FIG. 1, cap storage device 10 is illustrated as including upstanding back 12 attached at the rear of a horizontal base 14, such that a curvate lower shelf 16 may be superposed with respect to base 12. As illustrated in FIGS. 2 and 3, curvate lower shelf 16 may include an upper shoulder 18 conformed to engage the concavity formed by a folded cap crown. A plurality of vertically extending pegs 20, 22, 24 may be mounted at the periphery of base 14 both to limit peripherally the storage of caps stacked one upon the other and, as illustrated in FIG. 9, to serve as individual random supports for caps or hats.

In FIG. 3, a plurality of caps 28, 30 with extended visors 24, 32 are illustrated in phantom as stacked one upon the other such that the folded crowns are conformed to shoulder 18 of curvate shelf 16, while visors 34, 32 engage in vertical parallel the surface of upstanding back 12.

In FIG. 4, upstanding back 12 is shown as having mounting bracket 36 secured by means of set screws 40, 42, or the like, and embodying teeth 44 for engaging a nail or wall hanger (not illustrated). Curvate shelf 16 may be secured to upstanding back 12 by means of screws 48, 50, or the like, extending through back 12. Back 12, in turn, may be secured to base 14 by means of screws 52, 54, 56.

In FIG. 5, mounting bracket 36 is illustrated as offset with respect to unstanding back 12.

In FIG. 6, there are illustrated screws 58, 60 and 62 extending through the bottom of base 14 to engage upstanding pegs 20, 22, 24.

In FIG. 7, upstanding back 12 has been modified, such that its modified mounting bracket consists in keyhole concavity 46.

In FIGS. 8 and 9, the cap storage device 10 is illustrated as supporting a plurality of caps with folded crowns, stacked one upon the other, such that their visors extend in parallel engagement with the upstanding back 12.

In FIG. 9, this arrangement is enhanced by the use of upstanding pegs 20, 24 for random support of caps in use.

Figure 1:
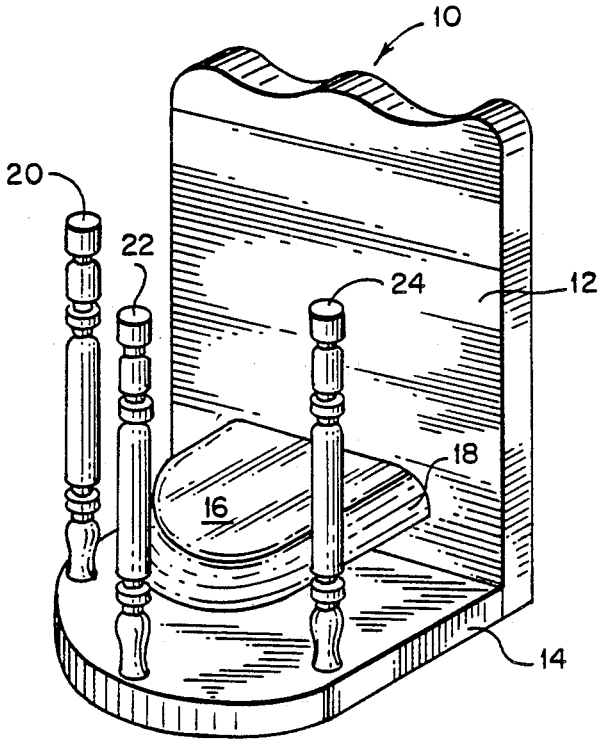
FIG. 1 is a perspective view of a cap storage device embodying horizontal base, upstanding back and a curvate lower shelf supported upon the back and superposed with respect to the horizontal base.
Figure 2:
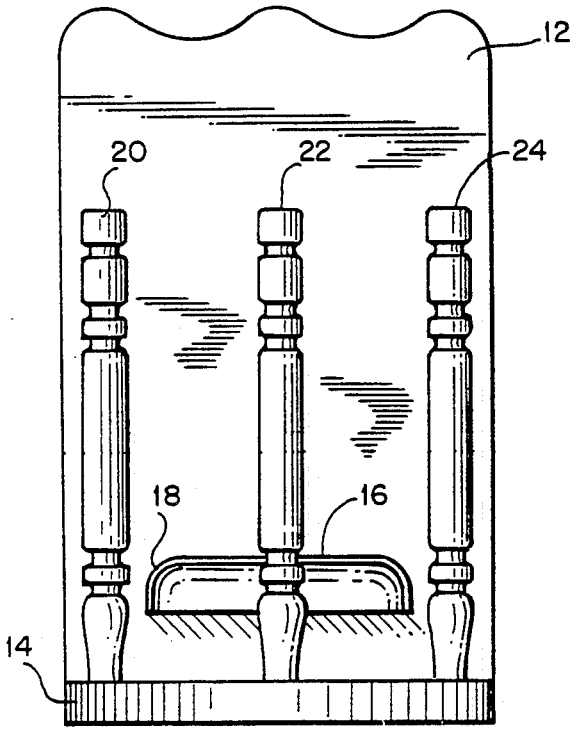
FIG. 2 is a front elevation.
Figure 3:
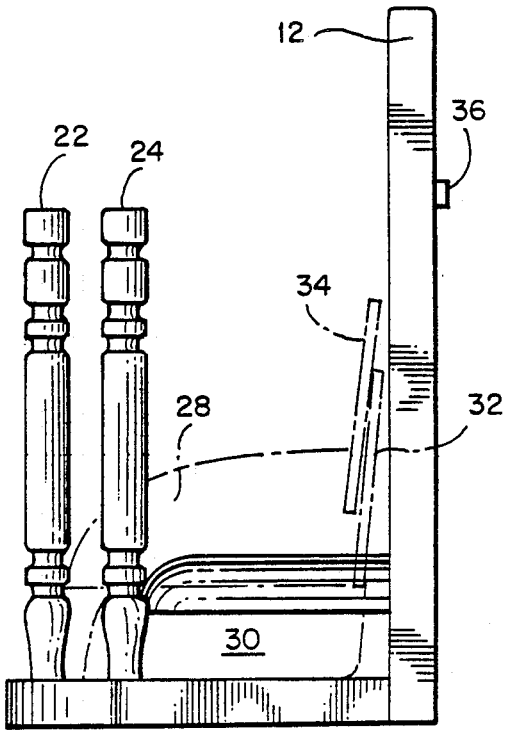
FIG. 3 is a side elevation, showing in phantom two caps with crowns folded and stacked one upon the other in storage mode.
Figure 4:
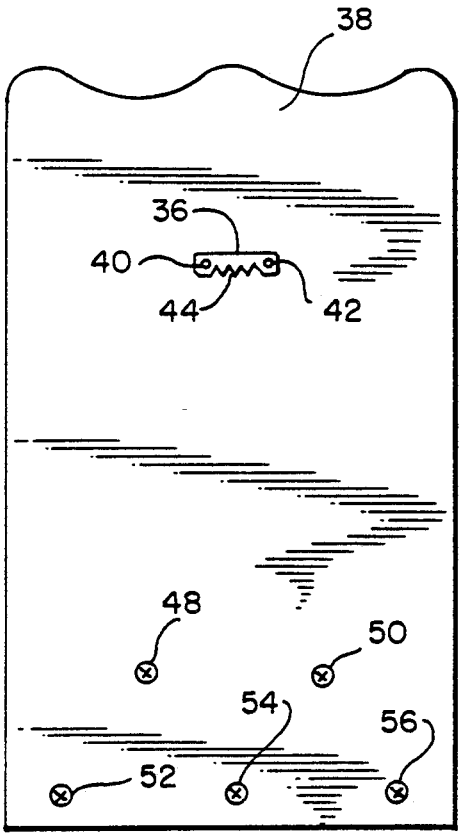
FIG. 4 is a rear elevation.
Figure 5:
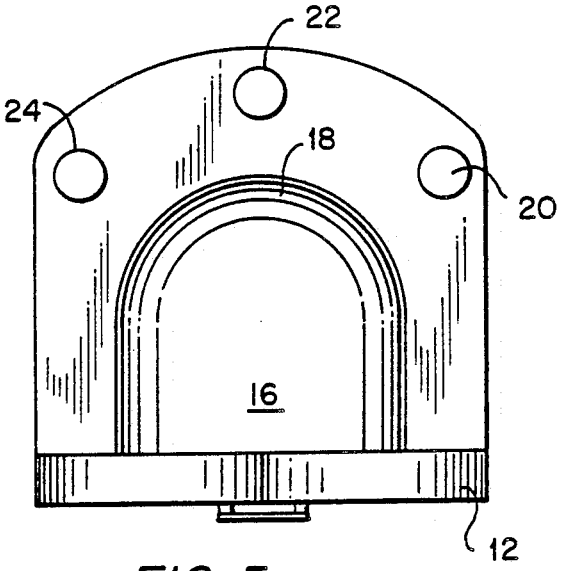
FIG. 5 is a top plan.
Figure 6:
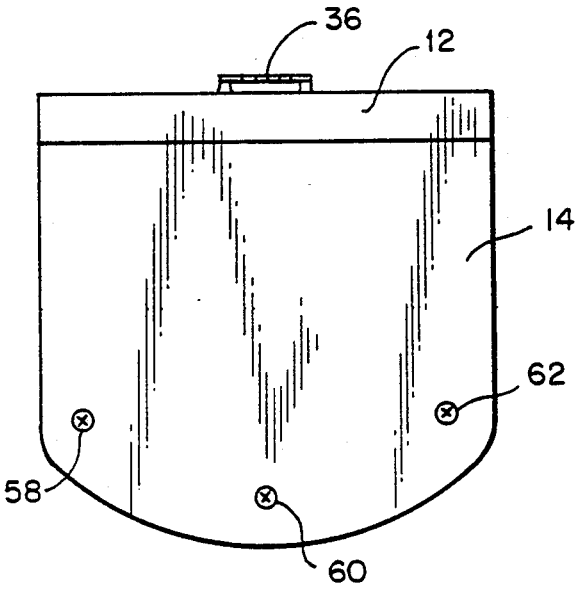
FIG. 6 is a bottom plan.
Figure 7:
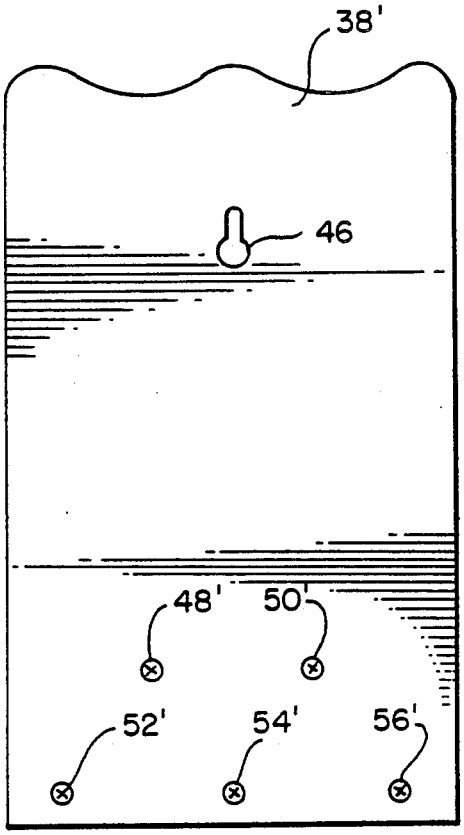
FIG. 7 is a rear elevation showing a modified mounting bracket.
Figure 8:
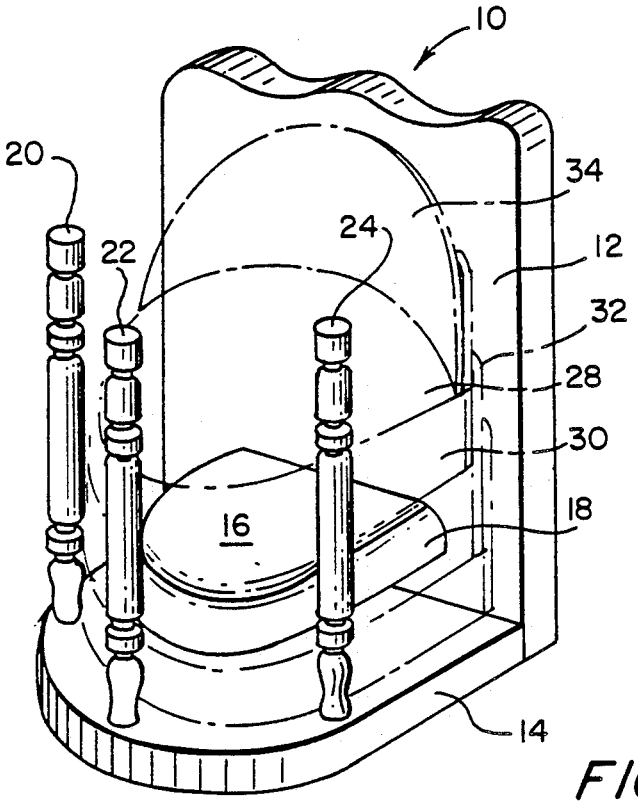
FIG. 8 is a perspective showing a plurality of caps with folded crowns stacked one upon the other such that the cap visors are in parallel engagement with the upstanding back.
Figure 9:
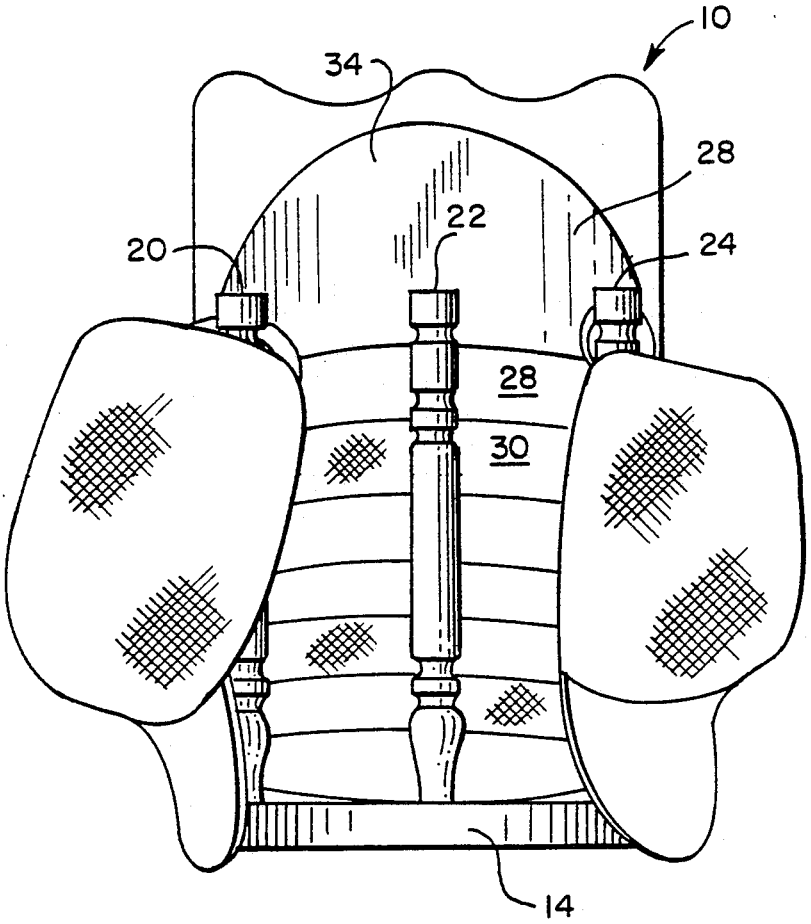
FIG. 9 is a front elevation showing a plurality of caps stacked one upon the other and two caps randomly supported upon the vertically extending pegs.

Manifestly, the cap storing device may be extensively modified without departing from the spirit and scope of the subjoined claims.

I claim:

1. A cap storage device adapted for storing a plurality of headpieces of the type having a crown with an extended visor comprising:

a. a horizontal base defining rear and front portions;

b. an upstanding back secured at its lower extremity to said base rear portion and extending vertically thereof, and c. a curvate lower shelf supported at one end upon said back and superposed with respect to said horizontal base, such that the crown of a cap may fit thereover with the cap visor extending vertically in parallel with said back.

2. A cap storage device adapted for storing a plurality of caps as in claim 1, in combination with a plurality of caps of the type having a crown with extended visor stored thereon, such that the visors of said caps are in parallel engagement with said upstanding back.

3. A cap storage device as in claim 1, said curvate lower shelf being configured to engage the folded inner crown of a cap with extended visor, while supporting a plurality of foled caps stacked one upon the other.

4. A cap storage device as in claim 3, said horizontal base including a plurality of vertically extending pegs supported at the outer perihery of said front portion as a guide for caps supported upon said curvate lower shelf.

5. A cap storage device as in claim 4, said vertically extending pegs being of a vertical height sufficient to engage a plurality of folded caps stacked one upon the other with respect to said curvate base.

6. A cap storage device as in claim 5, said vertically extending pegs being adapted for engagement with the inner crown of a cap as an additional storage feature.

7. A cap storage device as in claim 6, said upstanding back including a mounting bracket on its rear surface.

8. A cap storage device as in claim 7, said mounting bracket being in the form of a concavity defined in the rear surface of said upstanding back.

* * * * *